United States Patent [19]

Hudec

[11] Patent Number: 4,773,326

[45] **Date of Patent: * Sep. 27, 1988**

[54] PRINTING MACHINE WITH MANDREL WHEEL SKIP-PRINT VERIFICATION AND RESPONSE

[75] Inventor: Gordon D. Hudec, Westminster, Colo.

[73] Assignee: Adolph Coors Company, Golden, Colo.

[ * ] Notice: The portion of the term of this patent subsequent to Sep. 12, 2004 has been disclaimed.

[21] Appl. No.: 95,758

[22] Filed: Sep. 11, 1987

Related U.S. Application Data

[63] Continuation-in-part of Ser. No. 938,004, Dec. 4, 1986, Pat. No. 4,693,178.

[51] Int. Cl.[4] ..... B41F 17/22

[52] U.S. Cl. ..... 101/40; 101/426

[58] Field of Search ..... 101/38 R, 38 A, 39, 101/40, 426

[56] References Cited

U.S. PATENT DOCUMENTS 3,665,853 5/1972 Hartmeister et al. ..... 101/38 R X
4,693,178 9/1987 Hudec ..... 101/40

*Primary Examiner*—Clifford D. Crowder
*Attorney, Agent, or Firm*—Klass & Law

[57] ABSTRACT

A method and apparatus for the continuous printing of cylindrical containers which includes a method and apparatus for detecting malfunctions in a skip-print assembly thereof and for responding to detected malfunctions.

10 Claims, 4 Drawing Sheets

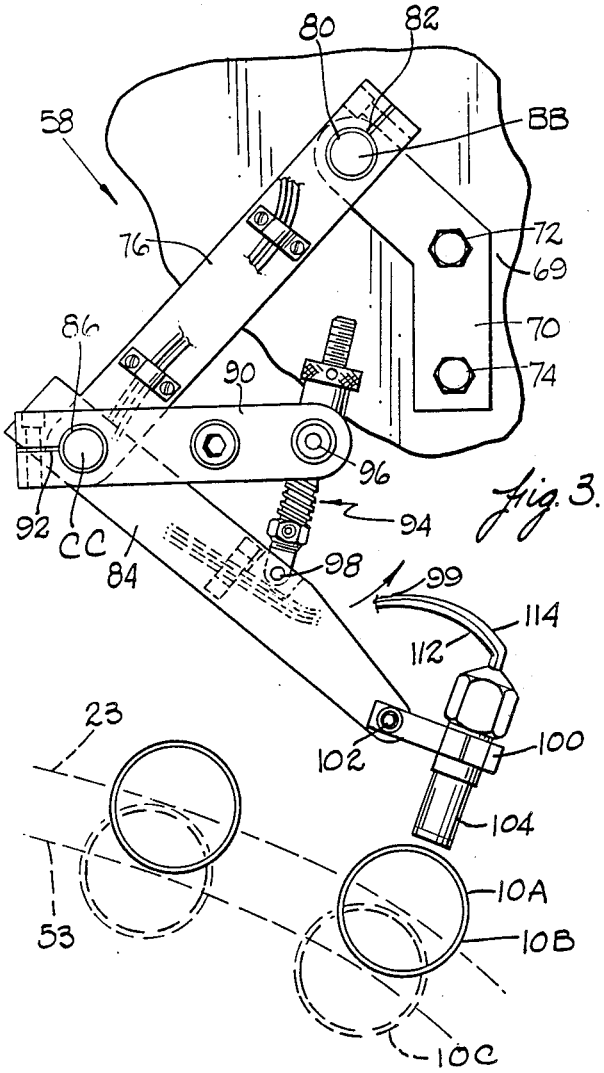
Fig. 3.
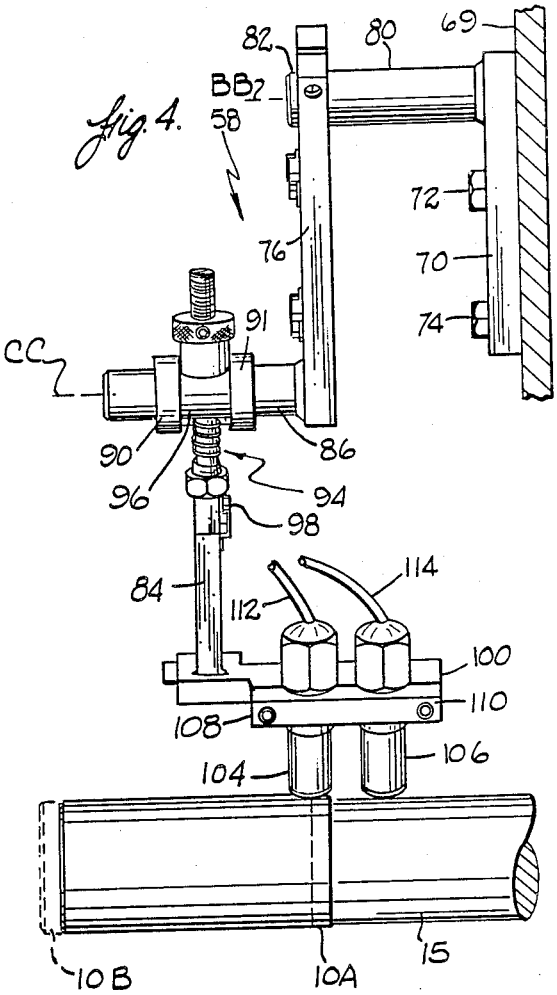
Fig. 4.
Fig. 5.
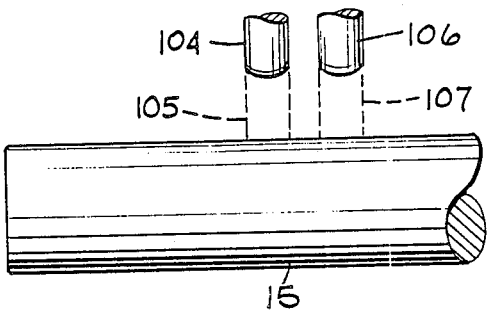

PRINTING MACHINE WITH MANDREL WHEEL SKIP-PRINT VERIFICATION AND RESPONSE

The present application is a continuation-in-part of copending U.S. patent application, Ser. No. 938,004 filed 12/4/86 of Gordon D. Hudec, which is now U.S. Pat. No. ∝,693,178, issued 9/15/87.

BACKGROUND OF THE INVENTION

The present invention relates to a high speed continuous printing (decorating) machine for printing (decorating) cylindrical containers such as can bodies and, more specifically, relates to a printing machine having a mandrel wheel skip-print apparatus malfunction sensing and response assembly.

Can printing (decorating) machines, especially high speed continuous can printing machines, operate by the impingement of a rotating, image-carrying blanket wheel and an oppositely rotating can carrying mandrel wheel assembly. The blanket wheel comprises an endless blanket which is at least as wide as the length of the cans being printed. The blanket carries a series of wet ink images circumferentially spaced on its resilient periphery. The mandrel wheel assembly comprises a mandrel wheel mounted with a series of circumferentially spaced, rotatable mandrels over which cans are fitted. The cans rotate on the mandrel wheel into registry and contact with the images on the surface of the blanket wheel. Each mandrel generally includes structure for removing cans from or drawing cans onto the mandrel.

During high speed can printing, a can will occasionally fail to properly seat on a mandrel or a gap will occur in the continuous can infeed to the machine causing one or more mandrels not to have a can received thereon. In such circumstances, it is necessary that the mandrel not be moved into contact with the blanket wheel to prevent the mandrel surface from being printed and contaminated. A number of different mechanisms have been utilized in the past to provide such a "skip-print" feature.

Hartmeister et al., U.S. Pat. No. 3,655,853 issued May 30, 1972, which is hereby specifically incorporated by reference for all that it contains, describes a continuous printer and skip-printer mechanism comprising a plurality of blanket holder segments on a rotated drum successively movable into and out of printing position, a stationary cam, a cam follower on each segment, and operative connections including a withdrawable bridge member between the cam follower and each blanket holder segment for moving the segment into printing position. An air cylinder responsive to a malfunction signal actuates a pivotally mounted trigger and connecting rod which are part of skip-print means for withdrawing the bridging member from the operative connections between the cam follower and each blanket holder segment, thereby producing a gap in the operative connections and preventing movement of the segment into printing position when malfunction occurs, without interrupting subsequent printing operations.

Zurick, U.S. Pat. No. 3,851,579 issued Dec. 3, 1974, which is hereby specifically incorporated by reference for all that it contains, describes a trip mechanism for a continuously rotating can printing or coating machine having rotatable can shaft supports, which is operable to displace the support from a print blanket. The trip mechanism includes an eccentric sleeve between the shaft and a bore which is rotatable with the bore and about the shaft. In a normal position, the sleeve holds the shaft in position to effect contact between a can mounted thereon and the print blanket. A detector provides a trip signal in response to the absence of a can. A trip cam and trip cam follower pair are provided, one of which is mounted on the eccentric sleeve. The trip cam is thrown from a normal print to a trip position in response to a trip signal. The trip pair is positioned to engage one another when the cam is in the trip position to cause rotation of the sleeve whereby the shaft and can support are displaced away from the print blanket.

Sirvet, U.S. Pat. 4,037,530 issued July 26, 1977, which is hereby specifically incorporated by reference for all that it contains, describes a pocket mandrel wheel having mandrels mounted on mandrel spindles that pivot to move the mandrels laterally to prevent the mandrels from contacting an associated printing wheel. The mandrel spindles are attached to the mandrel wheel by a pivot arm that controls the radius of the mandrel's line of motion as the mandrel wheel rotates. The pivot arm causes the mandrel spindle to rotate the mandrel in response to an electronic system that detects improperly seated cans on the mandrels. The pivot arm rests against an interposer block having a recessed step, and the mandrel is withdrawn when the block is moved in response to a signal from the electronic system so that the pivot arm rests against the recessed portion of the block. The movement of the block is controlled by a mechanical system that moves the pivot arm away from the block prior to the time when the mandrel may be tripped.

Other patents describing mandrel wheel operations, which are all hereby specifically incorporated by reference for all that is disclosed therein, include Cracho et al., U.S. Pat. No. 3,496,863 issued Feb. 24, 1970; McMillin et al., U.S. Pat. No. 4,138,941 issued Feb. 13, 1979; Skrypek et al., U.S. Pat. No. 4,140,053 issued Feb. 20, 1979; Stirbis, U.S. Pat. No. 4,267,771 issued May 19, 1981; Stirbis, U.S. Pat. No. 4,498,387 issued Feb. 12, 1985; Talbott, U.S. Pat. No. 4,129,206 issued Dec. 12, 1978; Urban et al., U.S. Pat. No. 4,018,151 issued Apr. 19, 1977; Zurick, U.S. Pat. No. 3,356,019 issued Dec. 5, 1967; Zurick, U.S. Pat. No. 3,491,686 issued Jan. 27, 1970; and Zurick, U.S. Pat. No. 3,521,554 issued July 21, 1970.

A problem with prior art skip-print systems has been that the trip mechanism for the skip-print system must be actuated prior to the time that a mandrel is in the immediate vicinity of the blanket wheel in order for the skip-print system to have sufficient time to move the mandrel from its ordinary, blanket wheel contacting path to a path which is spaced apart from the blanket wheel. In such a system, the detection device which senses the absence of a can or an improperly seated can on a mandrel is necesarily positioned a substantial distance "upstream" of the blanket wheel contact area. As a result of this upstream positioning, such a detection device cannot sense a can which becomes unseated from a mandrel at a point downstream of the detection device but upstream of the blanket wheel contact area. In extremely high speed machines, this problem is accentuated because the detection device senses a can/-mandrel seating arrangement prior to the time that the can seating (transfer of the can body from a pocket opposite a mandrel to the mandrel) is completed. Thus, a seating detection device is required to predict whether or not a given can will seat on a mandrel, rather than actually observing the proper seating or lack of proper seating. Since such "predictions" are necessarily less accurate than an observation of the can/mandrel seating arrangement immediately prior to contact of the can with the blanket wheel, misseated cans are occasionally printed. Such printing results in an improper image transfer to the can (known in the trade as "partial litho") as well as contamination of the associated mandrel with printing medium.

Another problem with prior art systems has been that the skip-print mechanical assembly for various reasons may not respond to a skip-print command signal from the detection device. Thus, even if the detection device properly senses a misseated can or the absence of a can, the skip-print system may malfunction due to a problem in the skip-print mechanical assembly or due to a problem in the signal transfer between the detection device and the skip-print mechanical assembly.

The printing of a mandrel having a misseated can or no can thereon is thus possible even if the mandrel wheel assembly is provided with a skip-print system. In view of this fact, it would be generally desirable to provide a system for monitoring the operation of the skip-print system and for detecting system malfunctions that will result in the printing of a mandrel. It would be further desirable to provide a system which takes appropriate corrective action in response to such a skip-print system malfunction so as to: (1) reject partially printed cans; (2) reject cans with ink on interior surfaces thereof caused by contact with a printed mandrel; and (3) clean any mandrel that has been printed.

SUMMARY OF THE INVENTION

A skip-print apparatus for preventing a mandrel, having an improperly seated cylindrical container thereon, from being printed by an associated blanket wheel is monitored for proper operation in the continuous printing machine of the present invention. In the event of skip-print apparatus malfunction, the system of the present invention initiates corrective action to remove improperly printed cylindrical containers and print medium contaminated cylindrical containers from production flow and to remove print medium from a printed mandrel.

The invention may comprise a continuous printing machine for cylindrical containers comprising: a blanket wheel carrying printing medium on a plurality of circumferential segments thereof for printing on the cylindrical containers said blanket wheel segments cyclically traversing a generally circular travel path; a mandrel wheel having a central axis of rotation positioned parallel to a central axis of rotation of said blanket wheel; a plurality of mandrels operably mounted on circumferential portions of the mandrel wheel for rotatably supporting said cylindrical containers thereon said mandrels cyclically traversing a generally circular travel path; said mandrels and said blanket wheel circumferential segment being displaceable relative one another in a printing region whereat said blanket wheel travel path and said mandrel travel path converge wherein a blanket segment entering the printing region traverses one of two travel path portions including a printing path portion and a skip-print path portion; a first mandrel seating detection means positioned proximate the mandrel travel path upstream of said printing region for detecting a proper seating state of a mandrel when a container mounted thereon is in a position associated with proper printing and an improper seating state of a mandrel when no container is mounted on the mandrel and when a container mounted on the mandrel is in a position associated with improper printing and for generating a detection signal indicative thereof; a path portion selection means for receiving said detection signal and for directing a blanket wheel segment associated with a sensed mandrel onto said printing path portion in response to a proper seating state detection by said first seating detection means and for directing a blanket wheel segment associated with a sensed mandrel onto said skip-print path portion in response to an improper seating state detection by said first seating detection means; said first mandrel seating detection means and said path selection means being subject to malfunction whereby a blanket wheel segment associated with a mandrel in an improper seating state is directed along said printing path and contaminates said improperly seated mandrel with printing medium; a malfunction sensing assembly for sensing a malfunction of said first mandrel seating detection means and said path selection means and generating a malfunction signal in response thereto; and malfunction response means for receiving said malfunction signal and responding to a sensed malfunction for removing printing medium from a mandrel contaminated through a sensed malfunction and for removing cylindrical containers which are misprinted or contaminated by printing medium associated with a sensed malfunction from a normal production flow of properly printed, uncontaminated containers.

The invention may also comprise a method of printing cylindrical container comprising: (a) providing a supply of unprinted containers to a rotating mandrel wheel having a plurality of mandrels mounted on a circumferential portion thereof; (b) serially mounting container from the container supply on the mandrels at a mandrels loading station; (c) detecting whether a mandrel is in a proper seating state associated with the proper positioning of a container thereon, or an improper seating state associated with the absence of a container or an improper seating container thereon, at a mandrel seating detection station positioned downstream of said loading station; (d) beginning at a path selection station downstream of the seating detection station, moving a blanket wheel segment associated with the detected mandrel along a printing path which will bring it into printing engagement with the associated mandrel in response to a proper seating state detection of the mandrel and moving the blanket wheel segment along a skip-print path which will cause it to bypass printing engagement with the mandrel in response to an improper seating state detection of the mandrel; (e) at a malfunction sensing station positioned along the blanket wheel segment travel path in the region where mandrel printing occurs detecting whether a blanket wheel segment associated with a sensed mandrel in an improper seating state has printed the associated mandrel; (f) at a container rejection station along a portion of the container flow path downstream of an area of printing engagement with the blanket wheel, rejecting a container carried by a mandrel detected to be in an improper seating state at said mandrel seating detection station and detected at said malfunction sensing station to have been printed; and (g) rejecting all containers carried by said mandrel detected to be in an improper seating state at said mandrel seating detection station and detected to have been printed at said malfunction sensing station during a predetermined number of mandrel wheel rotations subsequent to the detection of an improper seating state of that mandrel.

BRIEF DESCRIPTION OF THE DRAWINGS

An illustrative and presently preferred embodiment of the invention is shown in the accompanying drawings in which:

FIG. 3 is a detail side elevation view of the malfunction sensing apparatus illustrated schematically in FIG. 1;

FIG. 4 is a detail frontal view of the malfunction sensing apparatus illustrated in FIG. 3;

FIG. 5 is a partial frontal view of the malfunction sensing apparatus illustrated in FIGS. 3 and 4;

DESCRIPTION OF THE PREFERRED EMBODIMENTS

Figure 1:
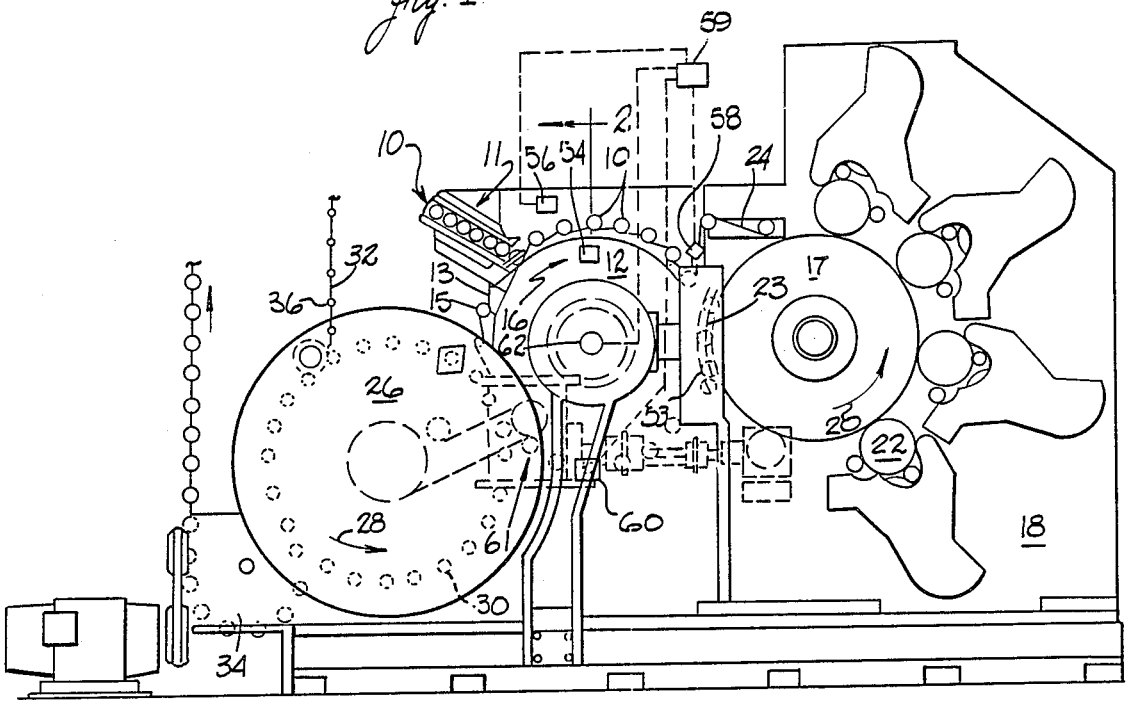
FIG. 1 is a schematic view illustrating the operation of a high speed continuous can decorating machine.

Referring now to FIG. 1, a conventional high speed continuous can printer is shown wherein cans 10 are fed through an infeed chute 11 to a mandrel wheel 12 comprising a plurality of circumferentially arranged pockets 13. Each pocket has a concave semi-cylindrical surface in which cans rest and are retained by gravity. The mandrel wheel also has a plurality of mandrels 15 which approximate the internal diameter of the cans 10 and which are axially aligned with the pockets 13 so that the cans may be slid from each pocket onto a corresponding mandrel by angled fingers (not shown) and a burst of compressed air. Cans are held against the mandrels by vacuum applied through the mandrels. Each mandrel and can thereon rotates continuously with the mandrel wheel in a generally circular path of travel in the direction of arrow 16 to the vicinity of a printing blanket wheel 17 mounted in radial opposition to the mandrel wheel on a machine stand 18. The blanket wheel 17 is driven in the direction of arrow 20 opposite to the direction of arrow 16 and carries on its periphery a smooth, segmented rubber printing blanket bearing wet reverse ink images to be transferred to the cans. The width of the printing blanket corresponds to the length of the cans. The ink images are placed on the blanket wheel by printing cylinder assemblies 22 mounted on the machine stand 18, there being one printing cylinder assembly and associated ink supply rolls for each color contained in the ink image. In the vicinity of the blanket wheel, the mandrels 15 depart from their circular path of travel and move in a path defined by a cam track in a concave path shown in exaggerated form at 23, in FIG. 1, which is concentric with the circumference of the printing blanket. The printing operation involves contact between the rotating can and a segment of the printing blanket during mandrel movement along the concave portion 23 of the mandrel assembly track.

During the printing operation, a can may be dented or for some other reason not properly seated on a mandrel. In order to prevent contamination of a bare mandrel with ink from the printing blanket, a "skip-print" mechanism is provided to prevent contact of a bare mandrel with the printing blanket. When the skip-print mechanism is actuated, an affected mandrel is caused to follow a skip-print path, shown in exaggerated form at 53, which is outwardly concentric with path 23 which prevents it from contacting the printing blanket.

After printing, the cans 10 again follow a circular path of travel at the periphery of the mandrel wheel to a transfer mechanism such as a continuously rotatable transfer wheel 26 mounted for rotation in the direction of arrow 28 parallel to the mandrel wheel and comprising a peripheral array of transfer devices, such as suction cups 30 extending axially towards the mandrels and rotating in cooperation therewith to pass oppositely of the mandrels. The transfer devices 30 are carried on the transfer wheel 26 to an output conveyor chain 32 powered by a chain drive 34 and comprising a plurality of pins 36. The pins 36 extend from the chain towards the cans on the transfer wheel and are spaced and arranged so that each pin enters a can on the transfer wheel and supports the can upon removal of suction from the suction cups 30. The cans 10 on the pins 36 move away from the suction cups and the transfer wheel and are carried to a drying oven for further handling.

A conventional can/mandrel seating detection device 56 is positioned at a fixed station proximate the periphery of the mandrel wheel 12 and detects improper seating arrangements on mandrels passing below it. As used herein, an "improper seating arrangement" or an "improper seating state" of a mandrel will refer to a situation in which a can is not in normal operating engagement with a mandrel and also to a situation in which a mandrel has no can mounted thereon, i.e. to any arrangement which would result in the printing of a mandrel if the skip-print mechanism were not actuated. A conventional skip-print actuation mechanism 54, sometimes referred to herein as a path selection assembly, is positioned at a fixed station immediately downstream of can/mandrel seating detection device 56. The skip-print actuation mechanism 56 co-acts with a conventional mandrel holder 40, FIG. 2, in response to a signal from seating detection device 56 to cause a mandrel having an improper seating arrangement to be moved in skip-print path 53, by which it does not come into contact with blanket wheel 17, rather than normal printing path 23. The seating detection device also provides a signal to data processing unit 59 which in turn sends a control signal to can blow off assembly 60 at a fixed station along the can path downstream of the blanket wheel to reject any can mounted on a mandrel in which an improper can seating was detected in the then current operating cycle (during the same revolution of the mandrel wheel as when the detection signal was issued). Such a rejection signal causes cans which are not printed due to operation of the skip-print assembly to be removed from the production flow 61 of normal printed cans.

Referring to FIG. 1, it may be seen that a skip-print malfunction sensing means 58 is mounted at a position adjacent to the mandrel wheel and immediately upstream of the point where mandrels on the mandrel wheel move into printing relationship with the blanket wheel 17. The malfunction sensing means 58 is positioned to sense the passage of mandrels and associated can bodies which are following printing path 23 at a relatively upstream portion of path 23 prior to actual printing contact with blanket wheel 17. Malfunction sensing means 58 comprises a mandrel detection sensor for detecting the presence of a mandrel in the immediate vicinity of the malfunction sensing means, and also a second mandrel seating detection sensor which detects whether a mandrel is in a properly seated state or an improperly seated state. Again, as used herein, a "properly seated state" of a mandrel refers to a situation in which a cylindrical container is seated on a mandrel in a manner such that the container will be properly printed. An "improperly seated state" of a mandrel refers to a situation in which a cylindrical container is not present on a mandrel, or in which a cylindrial container is only partially seated on a mandrel such that if the mandrel moves into printing relationship with the printing wheel 17, the mandrel will be contaminated with printing medium and any can mounted thereon will be improperly printed. A signal from malfunction sensing means 58 is processed and sent by data processing means 59 to blow off assembly 60 to remove a predetermined number of cans from a subject mandrel after detection of a malfunction so as to clean the mandrel and remove contaminated cans from production flow 61. Having thus described the invention in general, certain specific features thereof will now be described in further detail.

Figure 2:
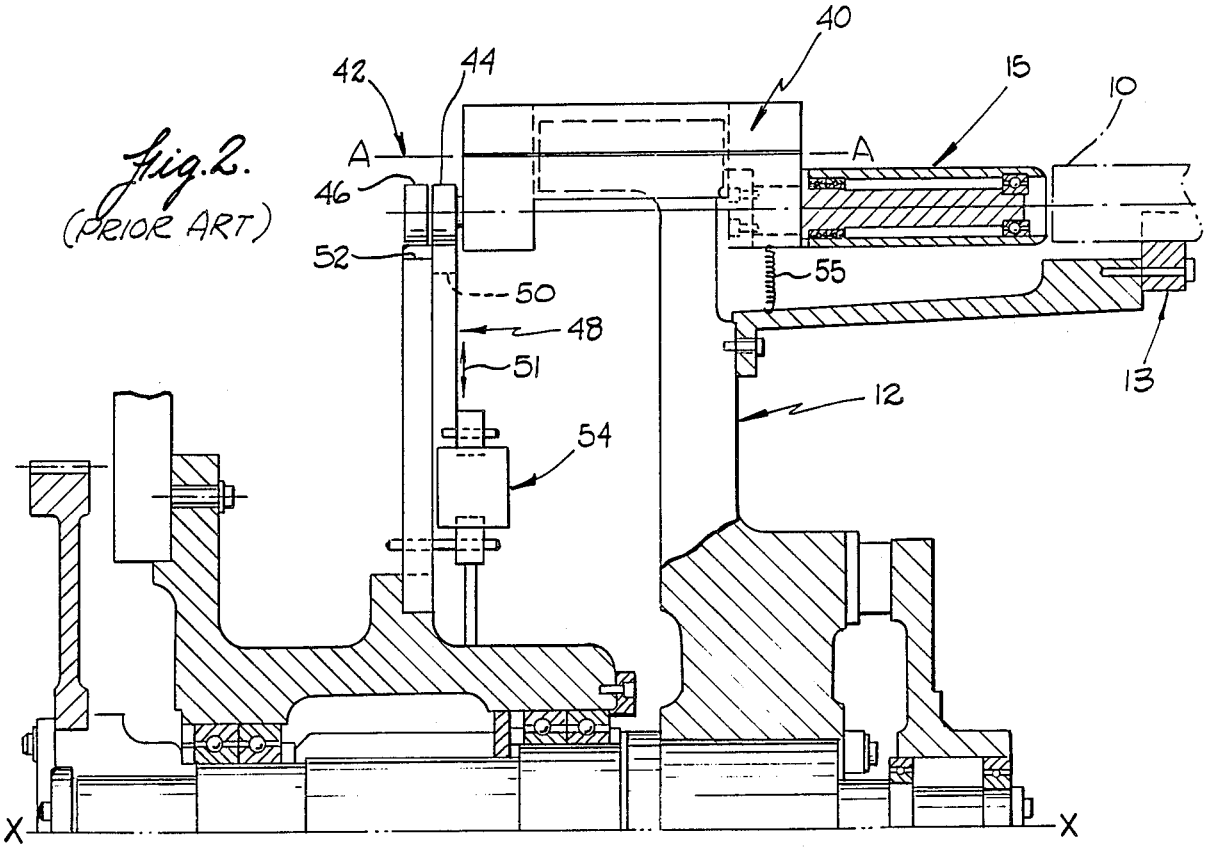
Fig. 2. (PRIOR ART)
FIG. 2 is a partially cross sectional detail elevation view of a portion of the mandrel wheel illustrated schematically in FIG. 1.

FIG. 2 shows details of a typical mandrel wheel assembly and associated trip mechanism. Each mandrel 15 comprises a cylindrical shape adapted to support an associated cylindrical container (can body) 10 thereon. Each mandrel 15 is mounted on an associated mandrel holder 40 which is in turn pivotally mounted on a circumferential portion of the mandrel wheel 12. In the illustrated embodiment, the mandrel holder 40 is rotatable about axis AA whereby the associated mandrel 15 is radially displaceable with respect to the circumference of the mandrel wheel 12. Each mandrel holder 40 has a cam follower assembly 42 mounted on an end portion thereof opposite the end at which mandrel 15 is mounted. The cam follower assembly may comprise a first and second cam follower 44, 46 which are adapted to be guided by a cam path assembly 48. The cam path assembly 48 comprises a first cam surface 50 which engages the first cam follower 44 during ordinary printing operation of the machine. Thus, the first cam surface 50 when engaged with follower 44 causes an associated mandrel to follow printing path 23 in the region of the blanket wheel. A second cam surface 52 is adapted to engage second cam follower 46 to cause an associated mandrel 15 to follow a skip-print path 53. A mandrel following skip-print path 53, rather than printing path 23, is not printed because of the relatively greater displacement of skip-print path 53 with respect to the blanket wheel 17. A path selection assembly 54 is actuated in response to a signal from mandrel seating detection sensor 56 positioned immediately downstream of can infeed chute 11. The path selection apparatus 54 is positioned at a fixed location downstream of sensor 56 and substantially upstream of the point where can bodies are printed by the printing wheel 17. In the illustrated embodiment, cam surface 50 is radially displaceable, as indicated at 51, by assembly 54. When surface 50 is in a radially outwardly positioned state, it engages cam follower 44 and causes the associated mandrel 15 to follow printing path 23. When surface 50 is in a radially inwardly positioned state, it does not contact cam follow 44, thus allowing cam follower 44 to engage cam surface 52, through action of biasing spring 55, to cause associated mandrel 15 to follow skip-print path 53. A detailed description of the operation of such a skip-print assembly is found in Stirbis, U.S. Pat. No. 4,498,387 issued Feb. 12, 1985, and incorporated by reference above.

Referring now to FIGS. 3 and 4, one embodiment of a malfunction sensing means 58 will be described in detail. The malfunction sensing means 58 may be attached to a fixed machine frame portion 69 of machine stand 18 by attachment plate 70 and by bolts 72, 74, welding, or other conventional attachment means. An adjustable first arm member 76 is pivotally attached to plate 70 for adjustable positioning about an axis BB, positioned parallel to the central axis of rotation of the mandrel wheel, as by shaft 80 and shaft engaging collar and tightening screw assembly 82. Shaft 80 is fixedly attached to plate 70. A second arm member 84 is mounted for free pivotal movement on a second shaft 86 by a conventional pivotal mounting means (not shown) and is pivotally displaceable relative to first arm member about axis CC position parallel to axis BB. Second shaft 86 is fixedly attached to an end portion of first arm 76. A biasing arm member pair 90, 91 are also pivotally adjustably mounted about shaft 86 by adjustable assemblies such as biasing arm collar and tightening screw assembly 92. A biasing plunger assembly 94 is pivotally attached as by journal member 96 between end portions of biasing arm members 90, 91 and is also attached as by pin member 98 to an intermediate portion of second arm member 84. Biasing plunger assembly 94 biases arm member 84 in the position illustrated in FIGS. 3 and 4. However, arm member 84 may move in the direction indicated at 99 in response to an external force such as may be applied by a mandrel in an abnormal radially displaced state which might be caused by a broken mandrel holder.

A sensor bracket 100 adjustably fixedly mounted as by bolt assembly 102 at a terminal end portion of arm member 84 fixedly supports a container body detector 104 having a scan area 105, FIG. 5, and a mandrel detector 106 having a scan area 107. The sensors may be mounted on the sensor bracket by conventional collar and screw assemblies 108, 110. The container body detector 106 may be a conventional aluminum detector which generates a detection signal in response to the presence of aluminum. The mandrel detector may be conventional steel detector which generates a detection signal in response to the presence of steel. Preferably, each detector has a sensitivity such that a detection signal will be generated if the associated metal is within 0.150 inches thereof and covers the entire scan area, and no signal will be generated if the associated metal is further than 0.150 inches therefrom or does not cover the entire scan area.

As illustrated in FIG. 3, cans such as 10A carried by mandrels traveling along printing path 23 are typically positioned at a distance (measured perpendicular to the axis of the can) of about 0.1 inches from sensor 104 when the associated mandrel is positioned directly opposite the sensor and the can is properly seated. Thus, a can such as 10A which is properly seated on an associated mandrel will be sensed by sensor 104 when it is in the position illustrated in FIGS. 3 and 4. The mandrel carrying can 10A will be sensed at the same time by sensor 106. In a situation where a mandrel travels printing path 23 but a can such as 10B, as shown in phantom in FIG. 4, is improperly seated thereon, sensor 104 will not sense the can because of the can's lateral displacement with respect to the scan area 105 of the sensor. The sensing of the mandrel by sensor 106 in this situation with no corresponding sensing signal from sensor 104 thus indicates an improperly seated can or no can on the sensed mandrel. Can 10C shown in phantom in FIG. 3 illustrates an improperly seated can on a mandrel traveling skip-print path 53. FIG. 5 shows a mandrel 15 having no can thereon positioned opposite sensors 104, 106 in skip-print path 53. In both these situations, the associated mandrel is sufficiently distant, e.g. 0.19 inches, from sensors 104, 106 so that no sensing signal is produced by either sensor. Thus, a malfunction signal is only generated in response to a mandrel detection signal from sensor 106 which is not accompanied by a corresponding can detection signal from sensor 104.

The sensors are provided with conventional lead wires 112, 114 for carrying detection signals to associated data processing means 59 which process signals from the sensors and generates an appropriate control signal to conventional cylindrical body blow off assembly 60. Processing means 59 may be either a programmable processing means such as a microcomputer or may alternately comprise hard wired circuitry.

The processing means 59 is provided with necessary software or circuitry and supporting hardware to monitor the relative position of each mandrel that is sensed by malfunction sensor 58. This supporting hardware may comprise an encoder unit 62, FIG. 1, which is mounted on a rotating shaft portion of the mandrel wheel and which provides an electronic signal indicative of the relatively rotated position of the mandrel wheel 12. The position of a mandrel 15 which is sensed by sensor 58 to be in an improperly seated state is continuously monitored by processing unit 59 for a predetermined number of mandrel wheel revolutions after the detection of the improperly seated state, and any can mounted on that mandrel during the predetermined number of revolutions is removed from the product flow 61 through appropriate control signals to blow off assembly 60. In one preferred embodiment, any can mounted on a mandrel 15 sensed by sensor 58 to be in an improperly seated state is blown off, and the next seven cans mounted on that mandrel in subsequent revolutions of the mandrel wheel are also blown off at assembly 60. The removal of a predetermined number of properly seated cans subsequent to the detection of a mandrel in an improperly seated state by sensor 58 insures that a mandrel, which is contaminated with ink by printing subsequent to being sensed by sensor 58, is cleaned by the contact with can bodies that are urged against it during subsequent normal printing cycles. The number of cans which are to be removed by blow off assembly 60 subsequent to the sensing of an improperly seated mandrel by sensor 58 is based upon the number of cans that must be urged against the mandrel to clean it. Since during this cleaning process the cans that are received on the contaminated mandrel will be contaminated with ink from the surface of the mandrel, removal of all such cans from ordinary production flow is necessary.

Another embodiment of the invention, which is specifically adapted for use on a printing machine of the type having a mandrel wheel with radially non-displaceable mandrels and a blanket wheel having radially deflectable blanket wheel segments, is illustrated in FIGS. 6–11. In this embodiment of the invention, as in the previously-described embodiment, a plurality of cans 210 are fed onto a mandrel wheel 212 by a conventional infeed assembly 211, such as an infeed chute and star wheel assembly. Mandrel wheel 212 may be identical to the previously-described mandrel wheel 12 except that the plurality of mandrels 215 mounted thereon are radially fixed in their location relative the mandrel wheel central axis of rotation rather than being selectively radially deflectable with respect thereto, like the mandrels 15 of the previously-described embodiment. The path followed by the radially most remote portion of a can mounted on a mandrel 215 is thus a constant radius circle portion 216 extending from the point of infeed from infeed assembly 211 to the mandrel wheel unloading station indicated at 214. The unloading of cans from the mandrel wheel may take place in the same manner as previously described with reference to FIG. 1. A blanket wheel 217 having a plurality of radially deflectable blanket wheel segments 218 thereon is positioned circumferentially adjacent to mandrel wheel 212 and rotates in a direction 222 opposite the the direction of rotation 213 of the mandrel wheel. The individual blanket wheel segments 218 are radially deflectable about a plurality of equally circumferentially-spaced blanket segment pivot points 220. A can printing surface 219 on each blanket wheel segment is engaged by one or more printing cylinder assemblies 224 which apply ink of different colors thereto. The ink applied to the printing surface 219 is subsequently transferred to a can mandrel on a mandrel 215 at the time when a blanket wheel segment 218 is positioned opposite a mandrel on mandrel wheel 212 as indicated at 225. In the illustrated embodiment there are three times as many mandrels as blanket segments, and thus the blanket wheel rotates at three times the rate as the mandrel wheel and each blanket wheel segment is associated with three different equally circumferentially spaced-apart mandrels. A blanket wheel segment deflecting assembly (not shown) positioned internally of the blanket wheel 217 is used to cause each blanket segment 218 to be pivoted outwardly about associated pivot shaft 220 when a blanket segment 218 is in a "printing region" in the immediate vicinity of the mandrel wheel 212 during normal printing operations. The path followed by a blanket wheel segment during a normal printing mode of operation is illustrated at 226 of FIG. 8. It may be seen that this path is generally circular except in a region 228 thereof in which the path projects radially outwardly from the normal circular path and follows the circumference of wheel 212 for a relatively short distance. The blanket wheel segment deflecting assembly may also be operated to cause a blanket segment to remain in a relatively unpivoted state in the printing region during a skip-printing operation to prevent the blanket segment from coming into printing contact with a can as the blanket wheel segment is moved into position opposite the mandrel wheel 212. The path followed by the surface of a blanket wheel segment during a skip-printing operation is illustrated schematically by FIG. 7 at path 230, which is generally circular in shape. A can seating detection device 232, like the detection device 56 previously described with reference to FIG. 1, is used to sense whether or not a can has been properly seated on a mandrel at a point upstream of the position whereat the can is printed by a blanket wheel segment. The signal from the seating detector 232 is processed by a data processing unit 234 which provides a control signal to actuate the blanket segment deflection apparatus appropriately, i.e. to cause an associated blanket segment 218 to follow printing path 228, FIG. 8, in response to the detection of a properly seated can or to cause an associated blanket segment 218 to follow skip-print path 30, FIG. 7, in response to the detection of an improperly seated can. Mandrel wheel and blanket wheel encoders 250, 52 may be employed in association with conventional control circuitry provided in processing unit 234 to enable the printed control system to continuously monitor the relative position of each mandrel and each blanket segment 218. Mandrel wheels and printing wheels such as described above in reference to mandrel wheel 212 and blanket wheel 217 are conventional and well-known in the art. Sensing units such as 232 and associated control circuitry and blanket segment print/-skip-print tripping assemblies are also conventional and well-known in the art.

Figure 7:
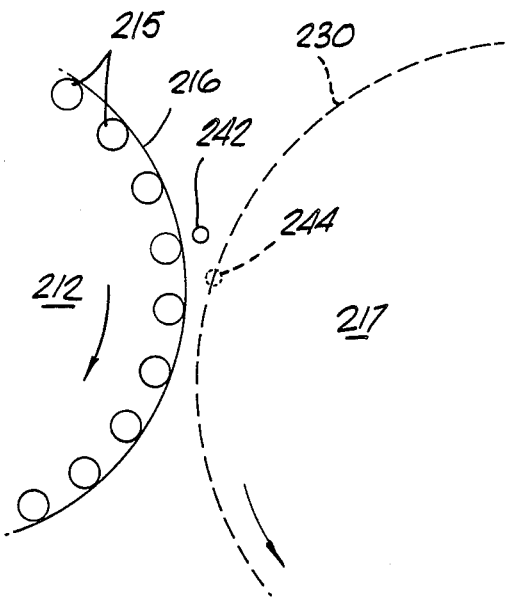
FIG. 7 is a schematic view showing the relationship between a mandrel wheel and blanket wheel of FIG. 6 in a skip-printing mode of operation.
Figure 8:
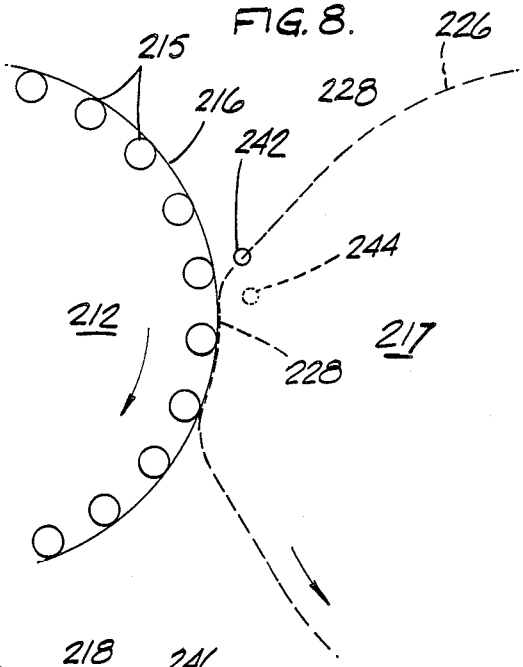
FIG. 8 is a schematic view showing the relationship between a mandrel wheel and blanket wheel of FIG. 6 in a printing mode of operation.
Figure 11:
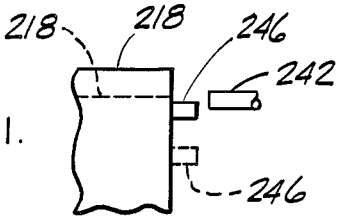
FIG. 11 is a detail side elevation view of a portion of a blanket wheel segment and blanket path detecting sensor.

In the present invention, monitoring devices and control circuitry are provided to verify the can seating and blanket segment deflecting functions which have been described in the immediately-preceding paragraphs. A can seating detection verifying device 240, which may comprise a convention can sensor, is positioned relatively downstream of can sensor 232 and is used to verify that the seating detection signal generated by can sensor 232 is correct. The signal output by sensor 240 is processed by data processing unit 234 in association with signals provided by a blanket segment path sensor 242. Blanket segment path sensor 242, which may comprise a conventional metal detector of the same general type as detector 106 previously described above, is positioned in slightly axially spaced relationship from the blanket wheel 217 at a radial location whereat the sensor 242 is placed in close proximity to an axially projecting stud 246 which is fixedly attached to each blanket segment 218 at a position thereon which is relatively remote from blanket segment pivot shaft 220. As shown in FIGS. 7, 8 and 11, when the blanket segment follows the printing path indicated at 226, 228, stud 246 is positioned at the same radial distance from the center line of the blanket wheel as sensor 242 and thus passes very near to sensor 242, causing a detection signal to be generated by sensor 242. When the blanket segment traverses the skip-print path indicated at 230 in FIG. 7, stud 246 is positioned radially more inwardly than sensor 242 and thus does not cause sensor 242 to generate a detection signal. The skip-print location of stud 246 is shown in dashed detection lines in FIG. 11. Thus, the absence of a signal from sensor 242 indicates that a blanket segment passing thereby is following the skip-print path and the generation of a signal from sensor 242 indicates that the blanket segment passing thereby is traversing the normal printing path. In a slight modification of this arrangement, a sensor 244 identical to that described above with reference to 242 is positioned at a location whereat the stud portion 246 will be positioned proximate thereto when the associated blanket segment is traversing a skip-printing path and remote therefrom when the associated blanket segment is traversing a printing path. In this arrangement, the presence or absence of a signal is interpreted just oppositely from that described above with reference to the signal from sensor 242. The sensor 242 or, alternately, sensor 244, is used to verify whether a blanket segment has responded correctly to a skip-print signal generated in response to the sensing of a can misseating by sensor 232. Thus, sensor 242 or, alternately, sensor 244, is used to verify the skip-print function performed by the blanket wheel segment deflecting apparatus in response to a skip-print command from data processing unit 234.

In a situation where sensor 232 indicates that a can is misseated and in which sensor 242 or 244 indicates that the associated blanket wheel segment has not followed a skip-print path and has thus been printed, the mandrel associated with the misseated can processing unit 234 generates a signal to a blow off assembly 236 to cause the misseated can to be blown off the mandrel into scrap hopper 238 subsequent to printing and to cause the next 10 or other predetermined number of cans to be blown off that mandrel in subsequent rotations of the mandrel wheel 212. Similarly, in a situation in which seating detection verification unit 240 senses that a can is misseated and in which sensor 232 has indicated that the can was properly seated and thus has not caused the generation of a signal which would cause an associated blanket segment 218 to follow a skip-printing path, the processing unit 234 again causes the can sensed by unit 240 to be improperly seated to be blown from the associated mandrel at blow off station 236 and also causes the next 10 or other predetermined number of cans to be blown off the associated mandrel in subsequent revolutions of the mandrel wheel 212.

In another slightly different embodiment of the invention, sensor 240 is eliminated and thus the seating detection verification function described above and the associated response is not provided.

Figure 6:
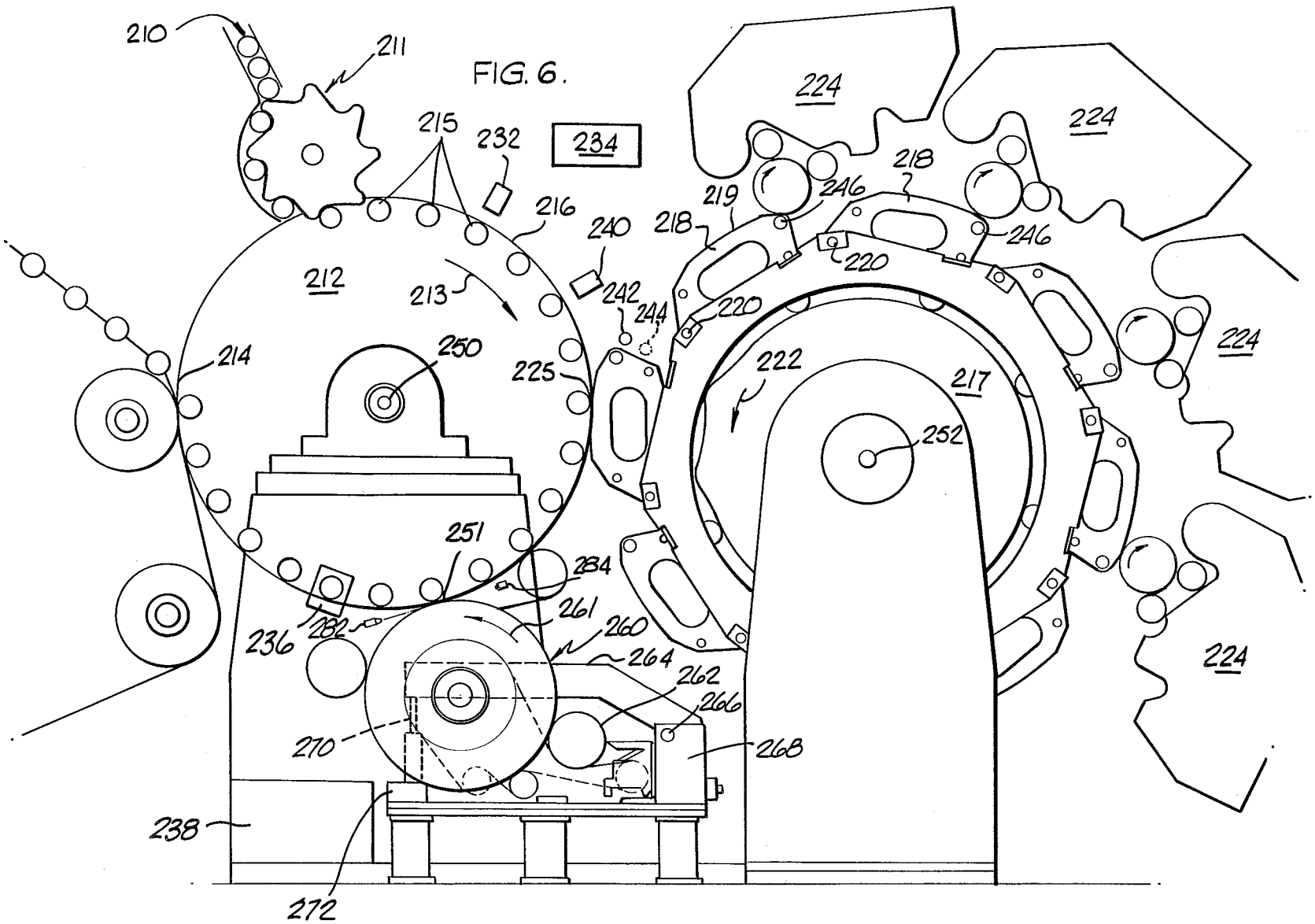
FIG. 6 is a schematic view illustrating the operation of a high speed continuous can decorating machine of an alternate configuration to that shown in FIG. 1.
Figure 9:
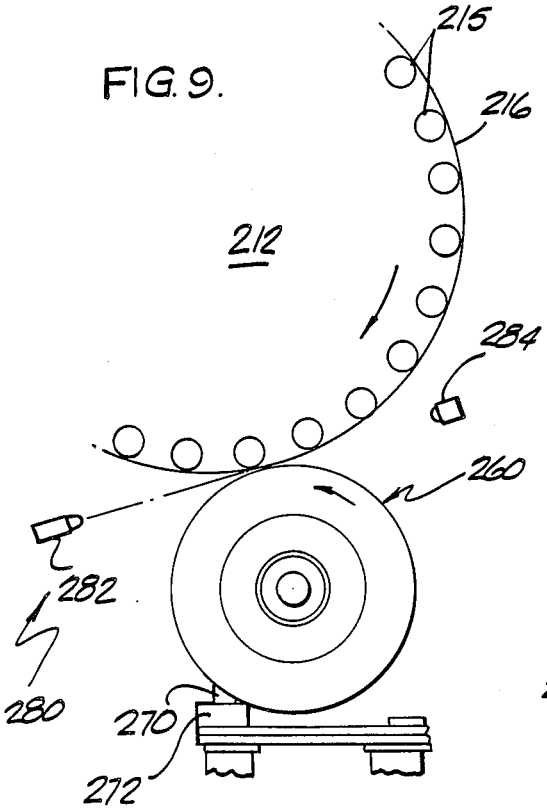
FIG. 9 is a schematic view showing the relationship between a mandrel wheel and overvarnish wheel of FIG. 1 in a printing mode of operation.
Figure 10:
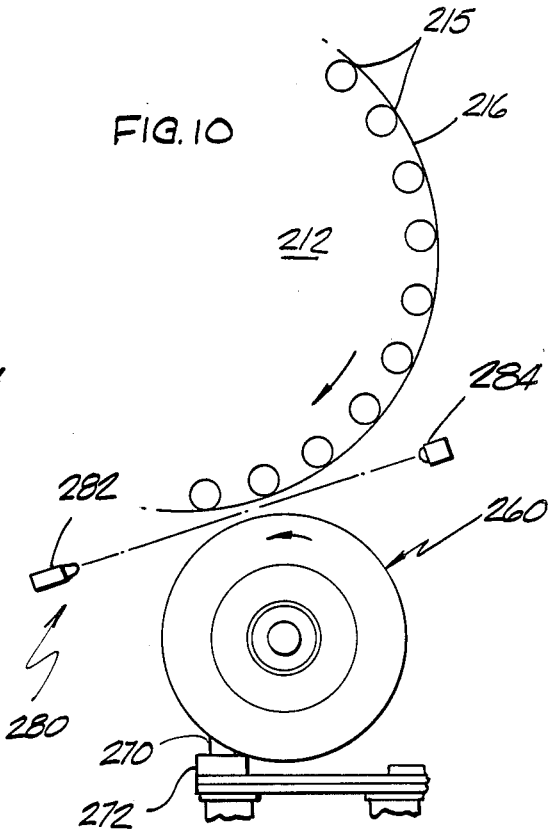
FIG. 10 is a schematic view showing the relationship between a mandrel wheel and overvarnish wheel of FIG. 1 in a skip-printing mode of operation.

As illustrated in FIGS. 6, 9 and 10, an overvarnish wheel 260 of a type well-known in the art may be positioned, as shown at 251, opposite the mandrel wheel 212 downstream from the position of engagement 225 between the mandrel wheel 212 and blanket wheel 217. The overvarnish wheel 260, which rotates in direction 261, applies a layer of varnish or other sealing medium to cans mounted on the mandrel wheel. The varnish is applied to the surface of wheel 260 by a varnish applicator 262 of a type well-known in the art. During normal printing operations, the varnish wheel is positioned, as indicated in FIG. 9, so as to make rolling contact with cans mounted on the transfer wheel 212 to coat the surface of the cans with varnish. As indicated in FIG. 10, the varnish wheel has a skip-print position which is provided by relative downward deflection of a varnish wheel support arm 264. The support arm pivots about pivot shaft 266 provided on support base 268. The pivotal movement of arm 264 is generated by a conventional power cylinder unit 270 which is controlled by a valve assembly 272 which is in turn actuated by a signal from data processing unit 234. It is conventional in the art for an overvarnish wheel such as 260 to be moved into non-printing relationship with mandrel wheel such as 212 during the passage of a misseated can detected by a sensor such as 232. In the present invention, a varnish wheel print position sensor assembly 280 is used to detect whether or not the varnish wheel has been properly deflected in response to a skip-print signal from data processing unit 234. The varnish wheel print position sensor assembly may comprise a laser beam generator 282 positioned to provide a laser light beam which is generally tangential to varnish wheel 260 and mandrel wheel 212 and which is slightly radially outwardly spaced from mandrel wheel 212. During normal printing operation, the varnish wheel 260 interrupts the laser beam. However, when it is in a skip-print position, the varnish wheel will not interrupt the laser beam and thus the light will be sensed by a photoelectric sensor 284 positioned on the opposite side of the varnish wheel. Sensor 284 thus generates a signal indicative of whether varnish wheel 260 is in a print position or is in a skip-print position. The signal from sensor 284 is processed by processing unit 234 in combination with signals from sensor units 232 and 240 in the same manner as described above with the processing of a signal from sensor unit 242 to cause misseated cans which have been printed by varnish wheel 260 to be blown off the mandrel by blow off unit 236 and to cause the next 10 or other predetermined number of cans to be blown off the associated mandrel during subsequent revolutions of the mandrel wheel 212.

It is contemplated that the inventive concepts herein described may be variously otherwise embodied and it is intended that the appended claims be construed to include alternative embodiments of the invention except insofar as limited by the prior art.

What is claimed is:

1. A continuous printing machine for cylindrical containers comprising:

a blanket wheel carrying printing medium on a plurality of circumferential segments thereof for printing on the cylindrical containers said blanket wheel segments cyclically traversing a generally circular travel path;

a mandrel wheel having a central axis of rotation positioned parallel to a central axis of rotation of said blanket wheel;

a plurality of mandrels operably mounted on circumferential portions of the mandrel wheel for rotatably supporting said cylindrical containers thereon said mandrels cyclically tranversing a generally circular travel path;

said mandrels and said blanket wheel circumferential segment being displaceable relative one another in a printing region whereat said blanket wheel travel path and said mandrel travel path converge wherein a blanket segment entering the printing region is positoned in relatively close proximity to an oppositely positioned mandrel in a printing mode of operation and is position in relatively remote proximity to an oppositely positioned mandrel in a skip-printing mode of operation;

a first mandrel seating detection means positioned proximate the mandrel travel path upstream of said printing region for detecting a proper seating state of a mandrel when a container mounted thereon is in a position associated with proper printing and an improper seating state of a mandrel when no container is mounted on the mandrel and when a container mounted on the mandrel is in a position associated with improper printing and for generating a detection signal indicative thereof;

a print/skip print selection means for receiving said detection signal and for positioning a blanket wheel segment and an associated sensed mandrel in relatively close proximity in said printing region in response to a proper seating state detection by said first seating detection means and for positioning a blanket wheel segment and an associated sensed mandrel in relatively remote proximity in said printing region in response to an improper seating state detection by said first seating detection means;

said first mandrel seating detection means and said path selection means being subject to malfunction whereby a blanket wheel segment associated with a mandrel in an improper seating state is positioned in relatively close proximately to said mandrel in said printing region and contaminates said improperly seated mandrel with printing medium;

a malfunction sensing assembly for sensing a malfunction of said first mandrel seating detection means and said path selection mean and generating a malfunction signal in response thereto; and malfunction response means for receiving said malfunction signal and responding to a sensed malfunction for removing printing medium from a mandrel contaminated through a sensed malfunction and for removing cylindrical containers which are misprinted or contaminated by printing medium associated with a sensed malfunction from a normal production flow of properly printed uncontaminated containers.

2. The invention of claim 1 wherein said malfunction sensing assembly comprises a second mandrel seating detection means positioned along said mandrel travel path downstream from said first mandrel seating detecting means for verifying detecting a proper seating state and an improper seating state of a mandrel prior to printing engagement of said mandrel with said blanket wheel and for generating a signal in response thereto.

3. The invention of claim 2 wherein said malfunction response means comprises means for rejecting a container mounted on a mandrel detected by said first mandrel seating detection means to be in an improper seating state and detected by said malfunction sensing means to have been printed by an associated blanket segment and for rejecting all immediately succeeding containers mounted on that mandrel up to a predetermined number associated with a decontamination of the mandrel through compressive wiping co-action between a container and the mandrel.

4. The invention of claim 3 further comprising mandrel wheel position indicating means for generating a wheel position signal indicative of the relative rotated position of said mandrel wheel and wherein said wheel position signal is received and processed by said data processing means for continuously determining the position of a mandrel sensed to be in an improper seating state by said second mandrel seating detection means for a predetermined number of revolutions after the detection of an improper seating state thereof and for actuating a container rejection device positioned at a rotationally fixed position opposite said mandrel wheel in response to the presence of said mandrel detected to be in an improper seating state whereby containers mounted thereon are selectively rejected from that mandrel by said rejection device.

5. A method of printing cylindrical containers comprising:

(a) providing a supply of unprinted containers to a rotating mandrel wheel having a plurality of mandrels mounted on a circumferential portion thereof;

(b) serially mounting containers from the container supply on the mandrels at a mandrels loading station;

(c) detecting whether a mandrel is in a proper seating state associated with the proper positioning of a container thereon, or an improper seating state associated with the absence of a container or an improper seating container thereon, at a mandrel seating detection station positioned downstream of said loading station;

(d) in a printing region whereat mandrel wheel and blanket wheel blanket segments are temporarily positioned in opposite relationship with one another, positioning a blanket wheel segment and an associated detected mandrel in close proximity to cause printing engagement between the blank wheel segment and a container which is ordinarily mounted on the asociated mandrel in response to a proper seating state detection of the mandrel and positioning the blanket wheel segment and an associated detected mandrel in relatively remote relationship in the printing region to prevent printing of the detected mandrel by the associated blanket segment in response to an improper seating state detection of the mandrel;

(e) at a malfunction sensing station detecting whether a blanket wheel segment associated with a sensed mandrel in an improper seating state has printed the associated mandrel;

(f) at a container rejection station along a portion of the container flow path downstream of the printing region, rejecting a container carried by a mandrel detected to be in an improper seating state at said mandrel seating detection station and detected at said malfunction sensing station to have been printed; and (g) rejecting all containers carried by said mandrel detected to be in an improper seating state at said mandrel seating detection station and detected to have been printed at said malfunction sensing station during a predetermined number of mandrel wheel rotations subsequent to the detection of an improper seating state of that mandrel.

6. The invention of claim 5 comprising the step of determining said predetermined number of mandrel wheel rotations based upon the number of containers which must be properly received on a contaminated mandrel and engaged by the printing blanket to remove contaminating printing medium from the mandrel surface.

7. A continuous printing machine for cylindrical containers comprising:

a printing wheel carrying printing medium on a circumferential surface portion thereof for printing on the cylindrical containers said printing machine having a printing mode of operation and a skip-print mode of operation;

a mandrel wheel having a central axis of rotation positioned parallel to a central axis of rotation of said printing wheel;

a plurality of mandrels operably mounted on circumferential portions of the mandrel wheel for rotatably supporting said cylindrical containers thereon said mandrels cyclically traversing a generally circular travel path;

said mandrel travel path and said printing wheel surface being displaceable relative one another in a printing region through relative radial shifting movement for providing said printing mode of operation and said skip-printing mode of operation of said printing machine;

a first mandrel seating detection means positioned proximate the mandrel travel path upstream of said printing region for detecting a proper seating state of a mandrel when a container mounted thereon is in a position asssociated with proper printing and an improper seating state of a mandrel when no container is mounted on the mandrel and when a container mounted on the mandrel is in a position associated with improper printing and for generating a detection signal indicative thereof;

a printing mode selection means for receiving said detection signal and for operating said printing machine in said printing mode during the passage of said sensed mandrel in response to a proper seating state detection by said first seating detection means and for operating said printing machine in said skip-print mode during the passage of said sensed mandrel in response to an improper seating state detection by said first seating detection means;

said first mandrel seating detection means and said printing mode selection means being subject to malfunction whereby said printing machine, during the passage of a mandrel in an improper seating state, is operated in said printing mode and contaminates said improperly seated mandrel with printing medium;

a malfunciton sensing assembly for sensing a malfunciton of said first mandrel seating detection means and said printing machine mode selection means and generating a malfunction signal in response thereto; and malfunction response means for receiving said malfunciton signal and responding to a sensed malfunciton for removing printing medium from a mandrel contaminated through a sensed malfunction and for removing cylindrical containers which are misprinted or contaminated by printing medium associated with a sensed malfunction from a normal production flow of properly printed, uncontaminated containers.

8. The invention of claim 7 wherein said malfunction sensing assembly comprises a second mandrel seating detection means positioned along said mandrel travel path downstream from said first mandrel seating detection means for verifyingly detecting a proper seating state and an improper seating state of a mandrel prior to printing engagement of said mandrel with said printing wheel and for generating a signal in response thereto.

9. The invention of claim 8 wherein said malfunction response means comprises means for rejecting a container mounted on a mandrel detected by said first mandrel seating detection means to be in an improper seating state and detected by said malfunction sensing means to have been printed by said printing wheel and for rejecting all immediately succeeding containers mounted on that mandrel up to a predetermined number associated with a decontamination of the mandrel through compressive wiping co-action between a container and the mandrel.

10. A method of printing cylindrical containers comprising:

(a) providing a supply of unprinted containers to a rotating mandrel wheel having a plurality of mandrels mounted on a circumferential portion thereof;

(b) serially mounting containers from the container supply on the mandrels at a mandrels loading station;

(c) detecting whether a mandrel is in a proper seating state associated with the proper postioning of a container thereon, or an improper seating state associated with the absence of a container or an improper seating container thereon, at a mandrel seating detection station positioned downstream of said loading station;

(d) locating a printing wheel and an associated detected mandrel in a printing position during the passage of the detected mandrel through a printing region which will bring the printing wheel into printing engagement With the detected mandrel in response to a proper seating state detection of the mandrel and locating the printing wheel and an associated detected mandrel in a skip-print position which will cause the printing wheel to by-pass printing engagement with the detected mandrel in response to an improper seating state detection of the mandrel;

(e) at a malfunction sensing station, detecting whether the printing wheel, during the passage of a sensed mandrel in an improper seating state, has printed the detected mandrel;

(f) at a container rejection station along a portion of the container flow path downstream of the printing region, rejecting a container carried by a mandrel detected to be in an improper seating state at said mandrel seating detection station and detected at said malfunction sensing station to have been printed; and (g) rejecting all containers carried by said mandrel detected to be in an improper seating state at said mandrel seating detection station and detected to have been printed at said malfunction sensing station during a predetermined number of mandrel wheel rotations subsequent to the detection of an improper seating state of that mandrel.

* * * * *

UNITED STATES PATENT AND TRADEMARK OFFICE

CERTIFICATE OF CORRECTION

PATENT NO. : 4,773,326

DATED : September 27, 1988

INVENTOR(S) : Gordon D. Hudec

It is certified that error appears in the above-identified patent and that said Letters Patent are hereby corrected as shown below:

Column 1, line 8, "No. ~~α~~,693,178" should read --4,693,178--.
Column 11, line 12, "path 30" should read --path 230--; and
line 15, "250, 52" should read --250, 252--.

In the Claims:

Claim 2, Column 14, line 28, "detecting" should read --detection--.
Claim 7, Column 15, line 13, "blank" should read --blanket--.
Claim 9, Column 16, lines 27-28, "malfunciton" (both instances) should read --malfunction--; and
lines 32-34, "malfunciton" (three instances) should read --malfunction--.
Claim 13, Column 17, line 2, "postioning" should read --positioning--.

Signed and Sealed this

Seventh Day of February, 1989

*Attest:*

*Attesting Officer*

DONALD J. QUIGG

*Commissioner of Patents and Trademarks*